US006434891B1

(12) United States Patent
Cameron

(10) Patent No.: US 6,434,891 B1
(45) Date of Patent: Aug. 20, 2002

(54) REINFORCED PANEL ARCH FOR SOFT-COVERED BUILDINGS AND THE LIKE

(76) Inventor: Michael W. Cameron, 107 Quincy Drive, Regina, Saskatchewan (CA), S4S 6L9

( * ) Notice: Subject to any disclaimer, the term of this patent is extended or adjusted under 35 U.S.C. 154(b) by 0 days.

(21) Appl. No.: 09/426,308

(22) Filed: Oct. 25, 1999

(51) Int. Cl.[7] ..... E04B 1/32
(52) U.S. Cl. ..... 52/86
(58) Field of Search ..... 52/86, 88

(56) References Cited

U.S. PATENT DOCUMENTS 3,097,494 A * 7/1963 Chapron
3,111,788 A * 11/1963 Ouellet
3,187,852 A * 6/1965 Carman et al.
3,748,796 A * 7/1973 Ouellet
3,881,285 A * 5/1975 Shumaker
3,968,603 A * 7/1976 Merson
4,280,306 A * 7/1981 Milinic
4,649,676 A * 3/1987 Davey
4,953,329 A * 9/1990 Frantl
5,233,799 A * 8/1993 Abukawa
6,026,613 A * 2/2000 Quiring et al.

* cited by examiner

*Primary Examiner*—Milton Nelson, Jr.
(74) *Attorney, Agent, or Firm*—Patterson, Thuente, Skaar & Christensen, P.A.

(57) ABSTRACT

A reinforced arch made of arcuate panel sections is disclosed. The addition of stiffening elements such as bracing or a tensioning apparatus to the arch increases the strength and stability of the arch. By attaching a plurality of these arches together in a spaced-apart relationship with a series of purlins, a high strength frame for a soft-covered building could be produced.

14 Claims, 3 Drawing Sheets

REINFORCED PANEL ARCH FOR SOFT-COVERED BUILDINGS AND THE LIKE

This invention relates generally to the field of soft-covered buildings and more specifically relates to the design of a strengthened panel arch therefore.

BACKGROUND

Soft-covered buildings are well known in the art, consisting of a number of supports anchored to a base and spaced apart by purlins or other braces. These supports often take the form of arcuate apparatus which, in conjunction with the purlins joining them, allow for the attachment of a soft fabric cover thereover, yielding a soft-covered building. These soft-covered buildings are economical to produce and can be rapidly erected.

Demand exists for increased size in these types of buildings.

The main limiting factor in building size is to be able to provide arch-shaped supports that are strong enough to withstand the loads associated with such a larger building. For example the cover of a larger building is heavier requiring greater strength in the supports, and the weather elements such as wind, or even in some cases earthquakes, can have greater effect on a larger building and this needs to be accommodated in building design.

SUMMARY OF THE INVENTION

It is an object of the present invention to provide a reinforced panel arch for soft-covered buildings and the like, which will allow for the construction of said arch from standard arcuate panel sections with the addition of stiffening elements to increase the strength of such an arch.

It is specifically contemplated that the arcuate panel sections to be used to build said arch would be corrugated steel panels, such as those used in the construction of steel quonsets or grain bins. These sinusoidally corrugated panels have considerate inherent strength of their own and an arch built of such panels should be useful in the construction of a soft-covered building provided that the arch can be significantly reinforced to add to the strength provided by the corrugations in the panel sections.

The basic panel arch produced by the attachment of one or more arcuate corrugated panel sections would be strengthened by the addition of stiffening elements thereto, in order to direct forces or loads exerted on or near the top of said arch down to the base of the arch and its base attachment and to distribute these loads without bending or otherwise damaging the arch.

Thus the invention, a reinforced panel arch for a soft-covered building or the like, accomplishes its objects comprising an arch comprised of at least one panel section, said arch having an underside and two base ends and a center point equidistant along the arch from each base end; and stiffening means attached along the underside of said arch.

The panel sections which are specifically contemplated are corrugated steel panels, similar in construction to those used in the construction of steel quonset buildings known previously in the art. The main difference between the panels contemplated for use here and those used in the construction of a conventional steel quonset would be width. While a sinusoidally corrugated panel used to construct a steel quonset might be four or more corrugations wide (typically on 24 inch centers), it is contemplated to use a panel of two corrugations in width in this case to lessen the weight and cost of the arch. It will of course be understood that panels of varying widths and constructions, with or without corrugations, could be used without departing from the scope of the claimed invention so long as these panel sections when joined together form an arch, having an underside to which the stiffening means can be attached.

As mentioned above, the stiffening means would be attached to the underside of the assembled panel arch in order to allow for a smooth and unobstructed upper surface on the arch. It is important to have a smooth upper surface on the arch so that for example in the case of a fabric covering being placed thereon to yield a soft-covered building there are as few protrusions as possible which might cause the fabric covering to rub or tear in the wind or other conditions.

In the case of corrugated panel sections being used to assemble the arch, the stiffening means could be attached in the channel between two downward-facing corrugations, so as to obscure as little of the open space defined within the arch while maintaining the position thereof on the underside.

Anchoring hardware could be placed at each base end of the assembled arch to allow the arch to be anchored to the surface to which the arch and/or building is to be attached. Various types of anchoring hardware could be used and insofar as they accomplish the objective of allowing the arch to be attached to a surface or other item it will be understood that all such variations and types of hardware are contemplated within the scope of the present invention.

Various types of stiffening means could be used to add strength to the arch in addition to any strengthening effect exhibited by any corrugations in the panel sections. The first type of stiffening means which is specifically contemplated is the attachment of hard braces along the underside of the arch. One or more braces could be attached between two points on the underside of the arch to add strength to the arch in its standing position and increase its ability to deal with the loads exerted on a soft-covered building.

It is specifically contemplated that one type of bracing arrangement which could be used would be to employ two straight first braces equal in size. Each straight first brace would be attached at or near the center point of the arch extending towards one of the base ends of the arch. The other end of each first brace would then be attached to the underside of the arch at an attachment point nearer to the respective base end of the arch. This would assist in the transfer of forces exerted near the top of the arch down along the arch closer to the ground.

The utility and efficiency of the first braces might be improved by the addition of a pair of second braces, straight also and equal in size. Each second brace would be attached to the underside of the arch near the point of attachment of one of the first braces to the arch furthest from the center point. The other free end of each second brace would then be attached to the underside of the brace, again closer to its respective base end.

Further pairs of braces might be added in a similar fashion.

The braces might be straight, or might in some fashion be shaped to accommodate the shape of the arch while assisting in the transfer of force exerted on the arch to the base.

A second method of stiffening the arch which is contemplated would be to use a tensioning apparatus. A series of eyelets could be attached along the underside of the arch in the direction of each base end and a cable fed therethrough. A tensioner, such as a turnbuckle or the like, could then be used to tighten this cable. One eyelet could be placed at the center point of the arch, and other eyelets could be placed in corresponding pairs towards the base ends of the arch.

A reinforced panel arch is disclosed comprising an arch comprised of one or more panel sections, said arch an underside and having two base ends and a center point equidistant along the arch from each base end; two equally sized straight first braces, each first brace attached to the underside of the arch at its one end at or near the center point of the arch and extending towards an opposing base end of the arch and being attached at its other end at a point towards said opposing base end; and two straight second braces of equal length, each second brace being attached to the underside of the arch at its one end at or near the point of attachment furthest from the center point of a first brace to the arch and being attached at its other end to the arch at a point closer to the closest base end of the arch.

Also disclosed is a reinforced panel arch comprising an arch comprised of one or more panel sections, said arch an underside and having two base ends and a center point equidistant along the arch from each base end; and a tensioning apparatus attached along the underside of the arch, said tensioning apparatus comprising a plurality of eyelets displaced along the underside of the arch, wherein one eyelet is at the center point of the arch, and other eyelets are in pairs equidistant from and on either side of the center point of the arch; a cable running freely through said eyelets from the eyelet closest to one base end of the arch to the eyelet closest to the other base end of the arch; and a tensioner to tighten said cable.

It will be understood that other types of stiffening means could be used to strengthen the arch also and insofar as they involve the attachment of stiffening or strengthening elements along the underside of the arch they will be contemplated within the scope of the present invention.

Also disclosed is a frame for a soft-covered building comprising a plurality of panel arches joined in a spaced-apart relationship by a plurality of purlins, wherein each panel arch is a panel arch of the present invention.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

FIG. 3 is a simple front line view of the arch of

FIGS. 1 and 2, demonstrating the configuration of the first and second braces.

DETAILED DESCRIPTION OF THE ILLUSTRATED EMBODIMENTS

Figure 1:
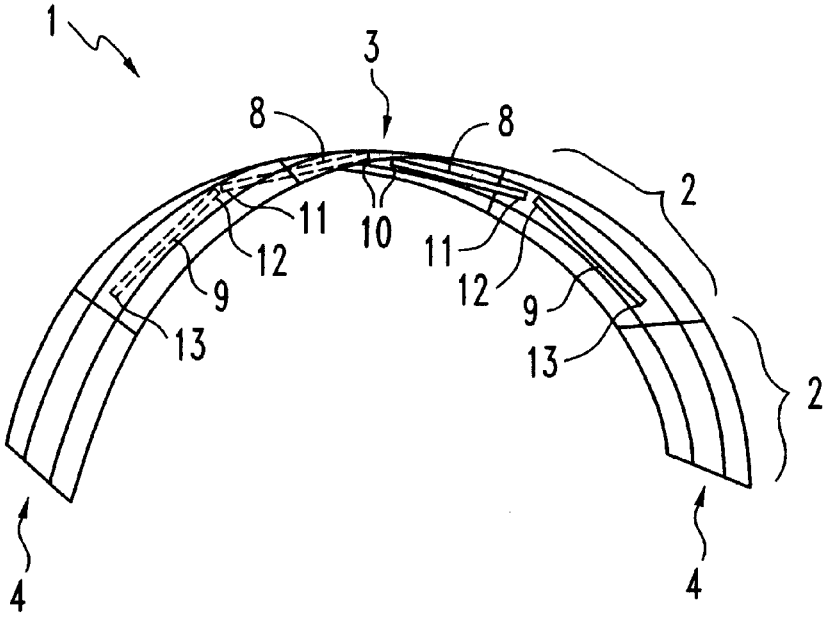
FIG. 1 is a perspective view of one embodiment of the arch of the present invention, employing straight braces as the stiffening means.
Figure 2:
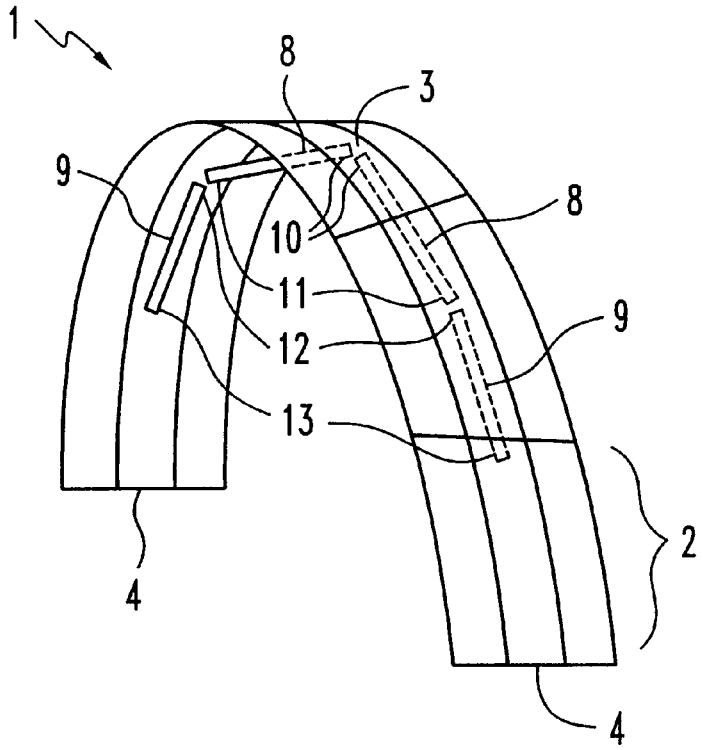
FIG. 2 is a side view of the embodiment of FIG. 1.
Figure 3:
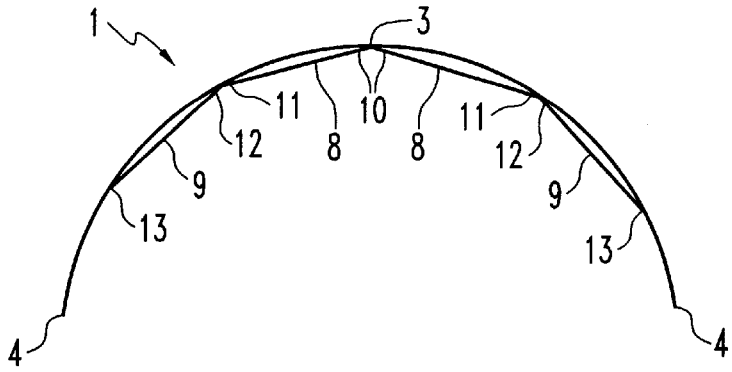

FIGS. 1 to 3 show a first embodiment of the reinforced panel arch (1) of the present invention. The arch (1) is built by the joining of several arcuate panel sections (2).

The panel sections (2) as shown are corrugated steel. The corrugations of the panel sections (2), if engineered properly, can provide some degree of strength to the arch itself without further strengthening, but in order to use a narrow arch to maximize the cost savings in building the soft-covered building with arches of this type in comparison to a steel arch quonset, as well as to lighten the arches to the maximum possible extent, it is considered desirable to use a corrugated steel panel of two and no more than three corrugations. In the case of a typical sinusoidally corrugated steel panel, each corrugation is likely on approximately a twenty-four inch center, although the precise nature of the corrugations is not material to the operability of the invention and as such it will be understood that any corrugated panel is contemplated within the scope of the present invention.

It will also be understood that non-corrugated panel sections could be used and that those are also contemplated within the scope of the present invention.

Arches of considerable size could be built by increasing the gauge, and perhaps the width, of the panel sections (2) used, and increasing the stiffening means used, The panel sections (2) when joined together form the arch (1). Points of reference on the assembled arch (1), for use in the remainder of this description, are the center point (3), and the base ends (4) of the arch (1).

Stiffening means are attached to the underside of the arch and are used to strengthen the arch (1). In the case of the embodiment of FIGS. 1 and 2, the stiffening means consists of a pair of first braces (8) and a pair of second braces The first braces (8) are each the same length, and in this embodiment are straight. Each of the first braces (8) is attached at one end (10) to the underside of the arch (1) at a point at or near the center point (3) of the arch. The other end (11) of each first brace is attached to the underside of the arch at a point closer to its respective base end (4). The point of attachment of the second end (11) of each first brace is reflective of the same point of attachment (11) of the other first brace.

As mentioned, in this particular embodiment there is also a pair of second braces (9) added to further strengthen the arch (1) beyond that provided by the first braces (8). Again in this particular case the second braces (9) are straight, and are equal in length. The second braces (9) are each attached at one end (12) near the point of attachment of the second end (11) of the first braces, and the other end (13) of each second brace is attached to the underside of the arch further along towards the base end (4).

These braces (8), (9) accomplish the effect of stiffening the arch (1) against forces being exerted on the upper part of the arch (1), and assist in the transfer of forces exerted on the arch (1) down towards the base end (4) of the arch and into the ground or other surface on which the arch (1) is erected.

It will of course be understood that any number of braces of this type might be used and that any such change is contemplated within the scope of the present invention.

As can be seen, the braces (8), (9) are positioned within the channel formed by two of the corrugations in the panel sections (2). This would not be necessary, but is an option in construction and assembly.

FIG. 3 demonstrates in a simple frontal line view the positioning of the first and second braces in relation to the underside of the arch.

Figure 4:
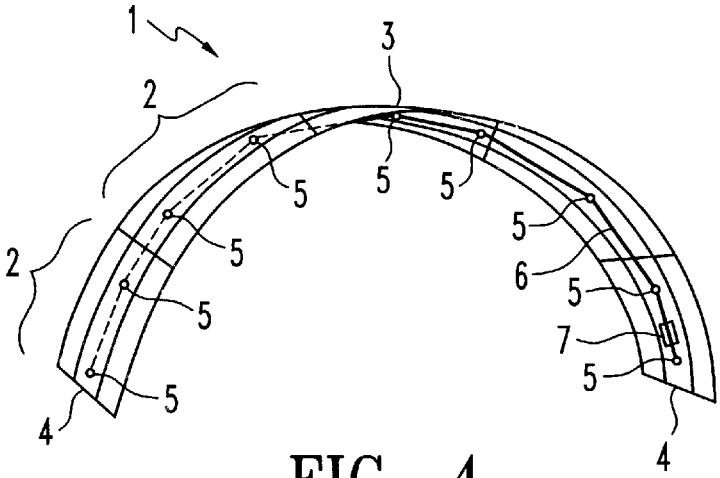
FIG. 4 is a perspective view of an alternative embodiment of the arch of the present invention, using a tensioning apparatus as the stiffening means.
Figure 5:
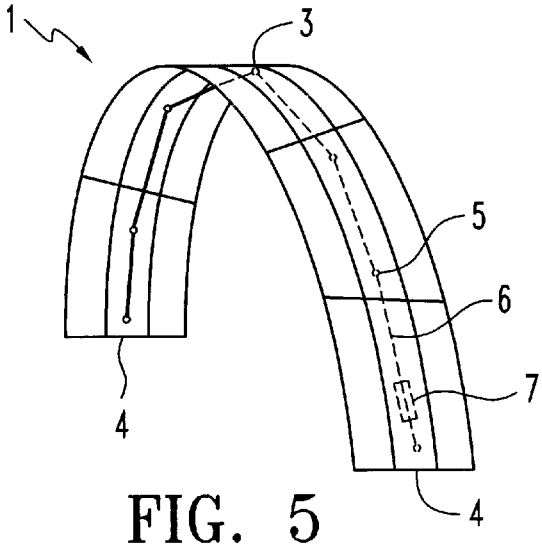
FIG. 5 is a side view of the embodiment of FIG. 3.
Figure 6:
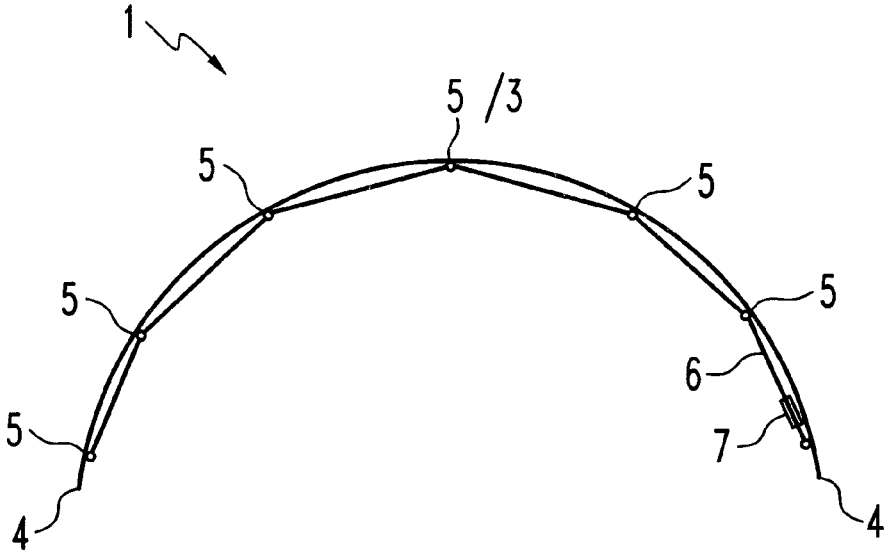
FIG. 6 is a front line view of the arch of FIGS. 3 and 4, demonstrating the position of the tensioning cable and apparatus.

FIGS. 4 to 6 demonstrate a different method of stiffening and reinforcing the basic panel arch of the present invention.

Instead of rigid bracing such as steel bracing bars or pipe sections being clamped on the underside of the arch (1), a tensioning apparatus is shown consisting of a series of eyelets (5) positioned along the underside of the arch (1), through which a cable (6) is Fed and attached at the eyelets (5) nearest to each base end (4) of the arch. A tensioner (7), such as a turnbuckle or the like, is then used to tension the cable (6) once the arch is assembled in position. The effect, shown in FIG. 4, is similar to the rigid bracing if FIG. 1 insofar as forces applied to the outside of the arch (1) will be translated down through the cable to the base end (4) of the arch, and/or distributed across the cable (6).

The cable (6) might be attached to the eyelet (5) at one end and then the tensioner (7) might engage the eyelet (5) at the other end and have the cable (6) attached thereto, or alternatively the cable (6) could be attached to eyelets (5) at each end and then the tensioner (7) attached in the middle of the cable (6) at some point.

It will be understood that various types of cables, chains, wires or other tensioning apparatus could be used to accomplish the objective outlined in terms of the embodiment demonstrated in FIGS. 4 to 6, and as such any such obvious alterations or materials changes are contemplated within the scope of the present invention as well FIG. 6 demonstrates in a front line view the use of the cable tensioning apparatus and the positioning of the tightened cable in relation to the underside of the arch.

Figure 7:
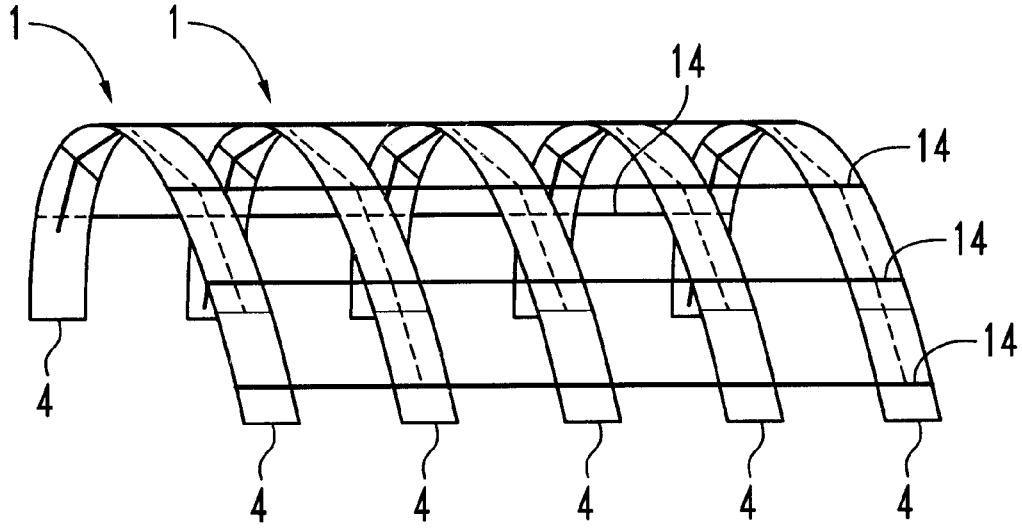
FIG. 7 is a side view of one embodiment of the building frame of the present invention.

FIG. 7 shows one embodiment of the building frame of the present invention. A frame for a soft-covered building could be built using a plurality of reinforced panel arches (1) of the present invention anchored to a footing, to the ground or otherwise, and braced in a spaced-apart relationship by a plurality of purlins (14), over which a fabric cover could be placed. The frame of FIG. 5 shows five arches, but it will be understood that any number of arches from two upwards could be joined together in a similar fashion.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

LISTING OF DIAGRAM REFERENCE NUMERALS

1. Reinforced panel arch;
2. Panel section;
3. Center point of arch;
4. Base end of arch;
5. Eyelet;
6. Cable;
7. Tensioner;
8. First brace;
9. Second brace;
10. First end of first brace;
11. Second end of first brace;
12. First end of second brace;
13. Second end of second brace
14. Purlins;

We claim:

1. A reinforced panel arch comprising:

a) an arch comprised of at least one panel section, said arch having an underside, two base ends, and a center point equidistant along said arch underside from each of said two base ends; and b) stiffening means attached along said arch underside, said stiffening means comprising a plurality of straight braces, each of said plurality of straight braces attached between two points on said arch underside.

2. The reinforced panel arch of claim 1, wherein said at least one panel section is made of steel having a plurality of corrugations.

3. The reinforced panel arch of claim 2, wherein said plurality of corrugations run between said each of said two base ends.

4. The reinforced panel arch of claim 3, wherein said stiffening means are mounted to said arch underside in a channel formed between two of said plurality of corrugations.

5. The reinforced panel arch of claim 1, further comprising anchoring hardware at said each of said two base ends.

6. The reinforced panel arch of claim 1, wherein said plurality of braces comprises two equally sized first braces, each of said first braces having a first end and a second end, said each of said first braces being attached at said first end contiguous to said arch center point and extending along said arch towards a respective arch base end, and each of said first braces being attached at said second end at a respective first point along said arch underside towards said respective arch base end.

7. The reinforced panel arch of claim 6, wherein said plurality of braces further comprises two equally sized second braces, each of said second braces having a first end and a second end, said each of said two second braces being attached at a first end to said arch underside at a respective second point contiguous to said respective first point and being attached at a second end to said arch underside at a respective third point, said respective third point being located further towards said respective arch base end.

8. The reinforced panel arch of claim 7, wherein said first point and said second point are the same point.

9. The reinforced panel arch of claim 7, wherein said first point and said second point are different points.

10. A frame for a soft-covered building comprising a plurality of arches joined in a spaced-apart relationship by a plurality of purlins, wherein each of said plurality of arches comprises at least one panel section, and wherein each of said plurality of arches has an underside, two base ends, and a center point equidistant along said arch underside from each of said two base ends, and further comprising stiffening means attached along said arch underside, wherein said stiffening means comprises a plurality of straight braces, each of said plurality of braces attached between two points on said arch underside.

11. The frame of claim 10, wherein said plurality of braces comprises two equally sized first braces, each of said first braces having a first end and a second end, said each of said first braces being attached at said first end contiguous to said arch center point and extending along said arch towards a respective arch base end, and each of said first braces being attached at said second end at a respective first point along said arch underside towards said respective arch base end.

12. The frame of claims 11, wherein said plurality of braces further comprises two equally sized second braces, each of said second braces having a first end and a second end, said each of said two second braces being attached at a first end to said arch underside at a respective second point contiguous to said respective first point and being attached at a second end to said arch underside at a respective third point, said respective third point being located further towards said respective arch base end.

13. A reinforced panel arch comprising:

a) an arch comprised of at least one panel section, said arch having an underside, two base ends, and a center point equidistant along said arch underside from each of said two arch base ends;

b) two equally sized straight first braces, each of said first braces having a first end and a second end, said each of said first braces being attached to said underside of said arch at said first end contiguous to said arch center point and extending along said arch towards a respective arch base end and each of said first braces being attached at said second end at a respective first point towards said respective arch base end; and c) two equally sized straight second braces, each of said second braces having a first end and a second end, said each of said two second braces being attached to said underside of said arch at said first end at a respective second point contiguous to said respective first point and being attached at said second end to said arch at a respective third point, said respective third point being located further towards said respective arch base end.

14. A frame for a soft-covered building comprising a plurality of arches joined in a spaced-apart relationship by a plurality of purlins, wherein each of said plurality of arches comprises at least one panel section, and wherein each of said plurality of arches has an underside, two base ends, and a center point equidistant along said arch underside from each of said two base ends, and further comprising stiffening means attached along said arch underside, wherein said at least one panel section is made of steel having a plurality of corrugations running between said each of said two base ends and wherein said stiffening means are mounted to said arch underside in a channel formed between two of said plurality of corrugations.

* * * * *